US005595030A

United States Patent [19]

Pulscher

[11] Patent Number: 5,595,030

[45] Date of Patent: Jan. 21, 1997

[54] VENT STACK FROST BUILD UP INHIBITOR

[76] Inventor: Calvin L. Pulscher, R.R. 1, Box 27, Aurora, S. Dak. 57002

[21] Appl. No.: 286,334

[22] Filed: Aug. 5, 1994

[51] Int. Cl.[6] ..... E04H 12/28; F23L 17/02

[52] U.S. Cl. ..... 52/218; 52/244; 454/13; 454/15

[58] Field of Search ..... 52/218, 219, 198, 52/199, 244; 454/12, 13, 14, 15, 17, 19

[56] References Cited

U.S. PATENT DOCUMENTS

| | | | |
|---|---|---|---|
| 1,010,799 | 12/1911 | Powell | 454/12 |
| 1,327,879 | 1/1920 | Pruden | 454/17 |
| 1,348,513 | 8/1920 | Morey | 454/19 |
| 1,362,044 | 12/1920 | Reich | 454/15 |
| 1,417,194 | 5/1922 | Morey | 454/19 |
| 1,456,099 | 5/1923 | Dufek | 454/15 |
| 1,463,664 | 7/1923 | Bowman | 454/14 X |
| 1,520,742 | 12/1924 | Basman | 454/15 |
| 1,585,714 | 5/1956 | Howard | 454/14 X |
| 2,806,417 | 9/1957 | Carroll | 454/48 |
| 3,017,818 | 1/1962 | Brewer | 454/12 X |
| 4,206,692 | 6/1980 | Johnston . | |
| 4,399,743 | 8/1983 | Izzi, Sr. . | |
| 4,442,643 | 4/1984 | Stadheim | 52/219 |
| 4,641,571 | 2/1987 | Anderson et al. | 454/19 |
| 4,732,078 | 3/1988 | Giumenta et al. | 454/12 X |
| 4,920,867 | 5/1990 | Joly | 454/12 X |
| 5,081,914 | 1/1992 | Mejia | 454/367 |
| 5,245,804 | 9/1993 | Schiedegger et al. | 52/199 |

FOREIGN PATENT DOCUMENTS

| | | | |
|---|---|---|---|
| 509084 | 10/1920 | France | 454/15 |
| 843166 | 7/1952 | Germany | 454/15 |
| 122766 | 2/1919 | United Kingdom | 454/15 |
| 152205 | 10/1920 | United Kingdom | 454/15 |
| 176969 | 3/1922 | United Kingdom | 454/15 |
| 1523406 | 8/1978 | United Kingdom | 454/17 |

*Primary Examiner*—Wynn E. Wood
*Assistant Examiner*—Laura A. Saladino
*Attorney, Agent, or Firm*—David L. Baker; Rhodes & Ascolillo

[57] ABSTRACT

An aparatus adapted to be mounted on a sewer vent stack to inhibit frost buildup in cold weather including a supporting frame containing a central rotatable shaft with a wind turbine on the end exposed and four vanes on the end within the vent pipe. The rotation of the shaft will cause frost build up to be scraped off by the vanes. Lack of rotation in a breeze will indicate excessive build up and a possibly dangerous situation.

4 Claims, 2 Drawing Sheets

VENT STACK FROST BUILD UP INHIBITOR

BACKGROUND OF THE INVENTION

1. Field of the Invention

The invention relates generally to specialized ventilation systems and more particularly to a ventilation system designed for use in conjunction with sewer vent pipes in cold climates.

2. Description of the Prior Art

A serious problem experienced by home owners in the cold weather regions of the world is that of frost accumulation in sewer vent pipes. The problem is caused by the use of ambient and warm water in routine daily living in areas where the air temperature remains well below freezing for days and weeks at a time. In order to properly plumb a home or commercial building for sewer there must be an air equalizing vent. Typically, when water is disposed of in the normal sewer system the water flows down and draws air in the vent to replace the air displaced by the water. When the water reaches the lateral lines some air moves in the reverse direction carrying with it among other things moisture and steam from the ambient and warm water discarded. When this air reaches the exposed portion of the stack, above the roof, in cold weather it will form frost on the inside of the stack. After a period of time the frost can build up and block the vent thereby preventing the ingress of air when using the system. In order to replace the air displaced by the water a vacuum will be created and suck the water from the traps in the building in order to allow air to enter the system. When the air reverses direction, with the vent blocked, the moisture laden air with sewer gases will enter the building, endangering the occupants of the building. In this respect, there have been a number of instances where sewer gas accumulation within a residence has resulted in the death of one or more of its occupants. In addition, many injuries have resulted where people have fallen from roofs while trying to thaw out their sewer vent pipes.

There are many examples of vent pipe covers as shown in the following U.S. Patents: U.S. Pat. No. 4,206,692 issued Jun. 10, 1980 to Johnston and U.S. Pat. No. 4,399,743 issued Aug. 23, 1983 to Izzi, Sr. U.S. Pat. No. 4,442,643 issued Apr. 17, 1984 to Stadheim recognizes the problem of cold weather frost build up but solves it by insulating the pipe above the roof line. U.S. Pat. No. 5,081,914 issued Jan. 21, 1992 to Mejia is another example of a roof vent cap and U.S. Pat. No. 5,245,804 issued Sep. 21, 1993 to Schiedegger et al. disclose a vent pipe shield.

As known to Applicant the prior art is devoid of methods and means for inhibiting the build up of frost on the sewer vent pipe in cold weather except by adding an insulated sleeve to the outside of the pipe as shown by Stadheim.

SUMMARY OF THE INVENTION

The invention is directed to a wind driven multiple vane apparatus that fits on a sewer vent pipe. A wind turbine is positioned above the terminus of the vent stack and is connected to a rotatable shaft that extends into the stack and contains multiple vanes. The vanes extend from the shaft into the proximity of the wall of the stack pipe. As a breeze or wind blows the wind turbine will rotate causing the shaft to turn and the vanes to rotate within the stack dislodging any frost build up on its wall. In the event there is substantial build up darning a calm and the wind turbine lacks the motive power to move the vanes, the lack of movement during a time of air movement acts as a warning sign to alert building occupants of a potentially hazardous frost build up.

Although the invention is described with regard to sewer vent stacks it is applicable to any vent stack that could be susceptible to frost build up in cold weather.

It is therefore an object of the invention to provide a new and improved vent stack frost build up inhibitor.

It is another object to provide a frost build up inhibitor that is self contained and uses only wind power.

It is a further object of the invention to provide a frost build up inhibitor that is simple in design and low in cost.

It is still another object of the invention to provide a frost build up inhibitor that provides a warning of excessive frost build up.

It is still a further object of the invention to provide a frost build up inhibitor that is of a durable and reliable construction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE PREFERRED EMBODIMENT

Figure 1:
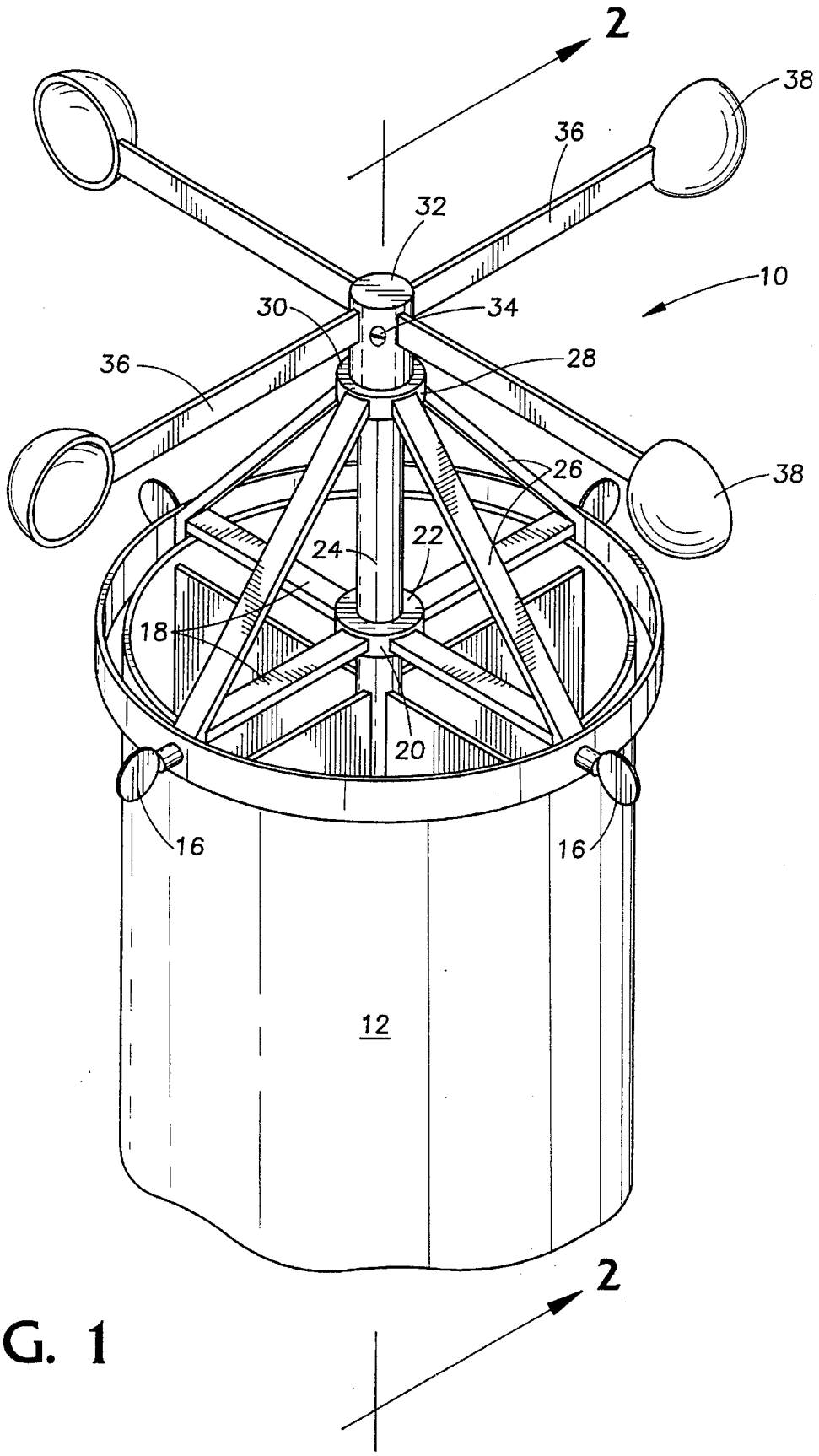
FIG. 1 is an environmental perspective view of the invention.

Referring now to FIG. 1, the invention is shown generally at 10 mounted on a vent stack 12. A ring 14 surrounds the vent stack with some clearance for adjustability by the securing threaded thumb screws 16. Four beams 18 engage the ring at the point of the thumb screw engagement and lie in a horizontal plane, transverse to the longitudinal axis of the vent stack. The beams meet at the center point of the plane and engage a bearing cup or holder 20. A sealed bearing assembly 22 rests in the holder 20 and provides direction and support for main shaft 24. Additional shaft support is provided by beams 26 which connect to ring 14 at the point of thumb screw engagement and lie in a frustro-conical plane with its apex along the extended longitudinal axis of the vent stack. The beams engage a bearing cup or holder 28 containing sealed bearing assembly 30 which provides support and stability for the main shaft 24. A shaft adapter 32 is connected to the end of the shaft and is held in place by set screw or other means 34. The shaft adapter is removable and allow for the assembly and disassembly of the apparatus. The adapter 32 rides on the bearing assembly and keeps the shaft in position when mounted in a vertical orientation. Substantially horizontal arms 36 attach to the shaft adapter and terminate in air capturing cups 38 that react to breeze or wind action by turning the shaft 24.

Figure 2:
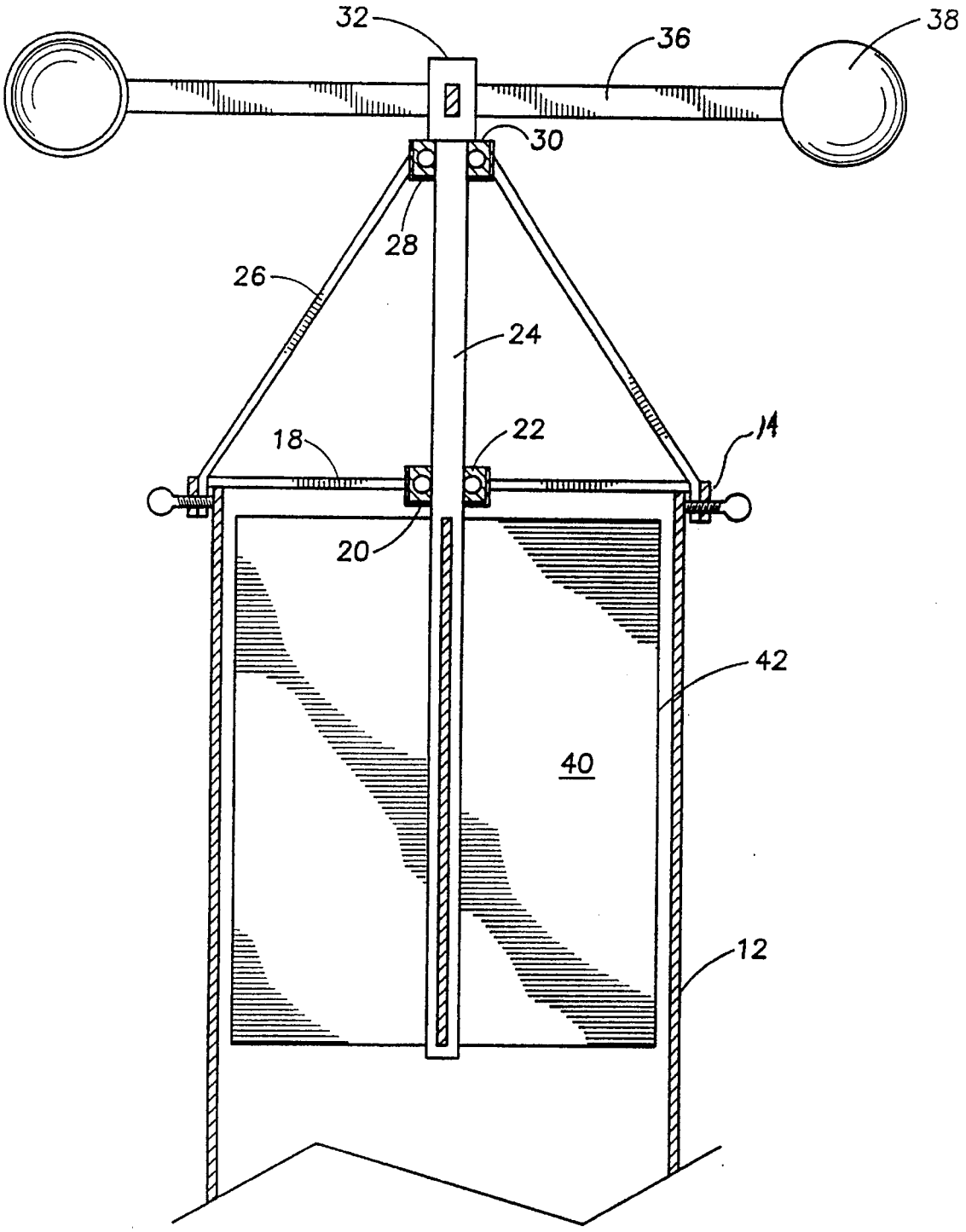
FIG. 2 is a side elevation view of the invention taken along lines 2—2 of FIG. 1

FIG. 2 shows the wind turbine mounted on the shaft 24 supported by bearings 22 and 30 and extending into the stack 12. Attached to the shaft are vanes 40 having a generally rectangular shape and extending to the proximity of the wall of the stack pipe. The shape of the vane is not critical to the invention so long as distal edge 42 is sufficiently large to displace the frost collecting on the side wall of the pipe. In a like manner the number and size of the air capturing cups must be sufficient to drive the vanes in a light breeze against the resistance of at least some frost build up.

The invention may be constructed from any material particularly including metal or a polymeric material with a low temperature utilization rating.

It should be understood, of course, that the foregoing disclosure relates to only a preferred embodiment of the invention and that numerous modifications or alterations may be made therein without departing from the spirit and scope of the invention as set forth in the appended claims.

What is claimed is:

1. A vent stack frost buildup inhibitor comprising:

a vent stack;

a ring for attaching the inhibitor to a vent stack;

means for adjustably securing the ring to the stack;

first beam means attached to the ring, in a plane transverse to the longitudinal axis of a vent stack, comprising four individual beams joining at the centerpoint of the said ring and engaging a bearing receiving and holding cup;

second beam means connected to the ring in a conical plane, having its apex along the longitudinal axis of the vent stack, comprising four individual beams extending at an acute angle to said transverse plane of the first beam means and joining at the apex of the conical plane and engaging a bearing receiving and holding cup;

a shaft extending along the longitudinal axis of the vent stack from a point distal to the apex of the conical plane to a point distal to the transverse plane;

a first bearing means connected to the first beam means;

a second bearing means connected to the second beam means whereby, the shaft extends through and is supported by the first and second bearing means;

a wind turbine means, attached to the shaft adjacent the second bearing means, comprising a plurality of air capturing cup shape means mounted at the ends of arms extending from a shaft adapter fitting;

the said first and second bearing means comprise sealed bearings;

means for removably securing the wind turbine to said shaft; and a plurality of rectangular vane means attached to the shaft adjacent the first bearing means and extending into the vent stack whereby, rotation of the wind turbine means will cause rotation of the vane means within the vent stack.

2. A vent stack frost buildup inhibitor according to claim 1 wherein the removably securing means is a set screw.

3. A vent stack frost buildup inhibitor according to claim 1 wherein the diameter of the circle generated by the rotating vane means is less than the diameter of the vent stack.

4. A vent stack frost build up inhibitor according to claim 1 wherein:

the means for adjustably securing the ring is a plurality of thumb screws threadedly engaging the ring and turned into the surface of the vent stack.

* * * * *